US007104732B2

(12) United States Patent
Mignacca

(10) Patent No.: US 7,104,732 B2
(45) Date of Patent: Sep. 12, 2006

(54) PILE INSTALLATION METHOD WITH DOWNHOLE HAMMER

(75) Inventor: Peter J. Mignacca, West St. Paul (CA)

(73) Assignee: Subterranean Ltd., West. St. Paul (CA)

( * ) Notice: Subject to any disclaimer, the term of this patent is extended or adjusted under 35 U.S.C. 154(b) by 0 days.

(21) Appl. No.: 10/871,608

(22) Filed: Jun. 21, 2004

(65) Prior Publication Data

US 2005/0281625 A1 Dec. 22, 2005

(51) Int. Cl.
*E02D 7/02* (2006.01)
*E02D 5/34* (2006.01)

(52) U.S. Cl. ..... 405/235; 405/249; 405/257

(58) Field of Classification Search ..... 405/231–233, 405/235, 249, 245, 256, 257; 173/104, 105, 173/108

See application file for complete search history.

(56) References Cited

U.S. PATENT DOCUMENTS 2,874,547 A * 2/1959 Fiore et al. ..... 405/254
3,543,524 A * 12/1970 Clements ..... 405/255
3,696,625 A * 10/1972 Alexander ..... 405/303
3,924,413 A * 12/1975 Marsh, Jr. ..... 405/251
4,623,025 A * 11/1986 Verstraeten ..... 175/21

FOREIGN PATENT DOCUMENTS

JP 57-133921 * 8/1982

* cited by examiner

*Primary Examiner*—Sunil Singh
(74) *Attorney, Agent, or Firm*—Adrian D. Battison; Michael R. Williams; Ryan W. Dupuis

(57) ABSTRACT

A pile is installed in a drilled hole in the ground by inserting a tube extending to the bottom and providing on the bottom end of the tube a bottom shoe for compressing material at the bottom of the hole. A drive tool attached to the upper end of the tube applies downward compression and reciprocating rotation forces to the tube. A hammer by-passes the drive tool to apply impact forces to an upper surface of the shoe at the bottom of the tube acting to drive the shoe in downward movement so that the shoe slides downwardly relative to the tube. A radial surface of the shoe causes compressive forces on the material at the bottom of the hole and blades on the radial surface when reciprocated back and forth by the tube cause break up of the compressed material to allow repeated compression and significantly increased supported loads on a pile which is applied with the tube removed and is supported on the shoe.

17 Claims, 13 Drawing Sheets

FIG.12
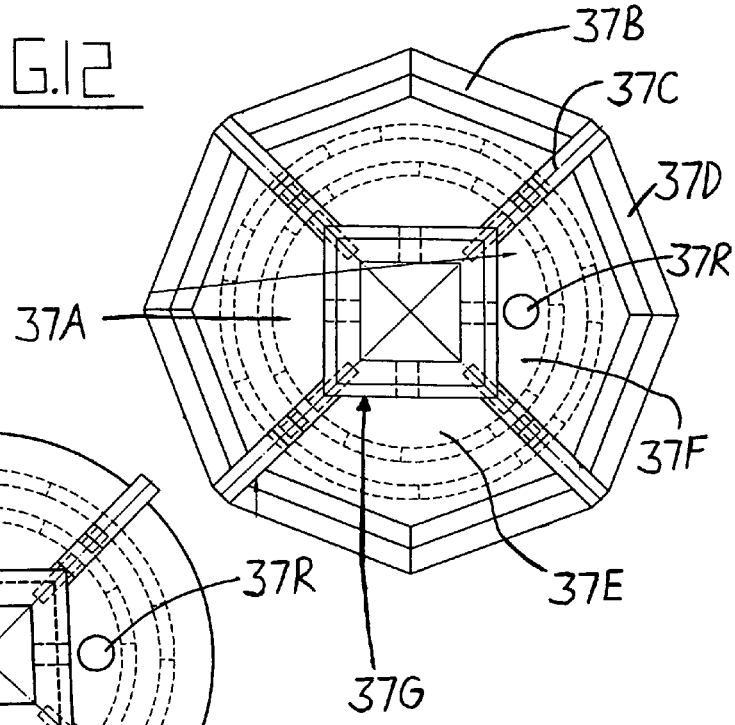
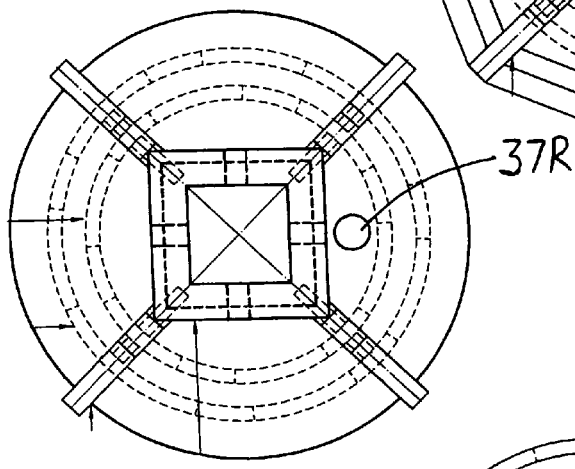
FIG.13
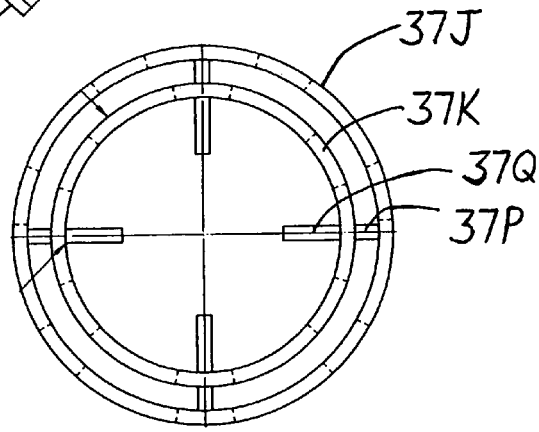
FIG.14

PILE INSTALLATION METHOD WITH DOWNHOLE HAMMER

This invention relates to a method of installing a pile, to an apparatus for installing a pile and to a pile installed using the method.

BACKGROUND OF THE INVENTION

The support of buildings on piles is of course a well established practice and the drilling and installation of piles is a highly competitive business required careful attention to costings. Yet further recent more attention to environmental issues has led to increased problems in driving piles into the ground particularly in respect to vibration damage and in respect of pollution generated by relatively crude impact hammers.

As is well established, very heavy structures are supported on piles which are drilled to bedrock. In many cases drilling to bedrock is an expensive requirement since the depth can be relatively long.

In intermediate structures providing a loading on each pile generally in the range 350 KN to 2400 KN (78,000 to 539,000 lbs.) it is generally not a requirement that the pile extend to bedrock and attempts are made to ensure that the pile is supported on sufficient level of compressed material to allow the required loading without the pile moving downwards under the loading. Well known testing procedures are available for testing the loading of a particular pile structure.

Many areas involve a soil construction which has an overlay of sedimental clay sitting on top of a layer of glacial till. Conventionally piles for mounting in this structure of soil require that the pile extend through the overlay of clay into the underlying till and extend into the till a sufficient distance for compression of the till to occur in the area underlying the bottom of the pile. The installation of such piles is generally carried out in the above soil conditions by driving a pre-cast concrete pile downwardly through the clay and into the till to a sufficient distance that the till is compressed. Driving is carried out generally by a hammering action on the top of the pile either using a simple crude drop hammer which is raised and lowered on a winch or by more technically advanced mechanical hammers which are held stationary above the pile and which apply a hammering action to the top of the pile.

These systems of applying impact forces to the pile have a number of significant disadvantages. Firstly the manufacture of the precast concrete pile is very expensive and problematic so that the installer requires to rely upon the manufacturing schedule and costings of a pile supplier which may be unsatisfactory. Secondly the action of impacting upon the pile leads to significant shockwaves traveling through the ground at the upper levels of the ground. These shockwaves are potentially damaging to adjacent structures so that such structures need to be protected. Even where no damage actually occurs, there is a risk that owners of adjacent structures have the perception that their structure has been or may be or is being damaged and so may raise complaint.

Another form of pile installation shown for example in a brochure by IHC Fundex Equipment of The Netherlands is known as a displacement pile or "soil displacement drilling" in which a tubular structure with a shoe at the lower end is inserted into an initial drilled hole where the bottom of the drilled hole terminates at the bottom of the clay layer. With the tubular member inserted into the hole, the tube member with the attached shoe is driven further into the ground by simultaneous downward compression forces and reciprocating rotational movement or rotational movement in a single direction. The shoe is shaped and arranged to act to break up and disperse the material in the till layer underneath the bottom of the tubular structure so that the vertically downward forces on the tubular structure can drive the tube and the shoe downwardly into the till.

However this technique is not widely accepted since the depth of penetration is very much limited before the compaction of the till underneath the shoe prevents further downward movement. The compaction achieved in this way is thus only sufficient for loading of the order of 270 KN which is generally unsatisfactory for conventional building techniques and structures which require higher loadings. This technique has therefore not been widely adopted except in certain specific areas, such as in Holland and Florida where land reclamation has been used providing ground conditions which are particularly conducive to this technique.

In most cases therefore where the ground conditions include the underlying glacial till and the overlying clay, the present technique is to use the above precast concrete pile which is driven by impact forces to the required depth. The impact forces provide sufficient compression of the underlying material to provide an increased level of loading up to a required amount generally necessary for buildings of this type.

However there remains a requirement for replacing the driven pre-cast concrete pile both for reasons of cost and for environmental damage.

SUMMARY OF THE INVENTION

It is one object of the invention to provide an improved method for installing piles which allows a significant increase in supportable load on the pile.

According to one aspect of the invention there is provided a method for installing a pile in the ground comprising:

drilling a hole in the ground to a bottom of the hole at an initial depth;

inserting in the hole a tube extending along the length of the hole to the bottom;

providing on a bottom end of the tube a bottom shoe for engaging material at the bottom of the hole;

inserting into the tube a hammer and operating the hammer to apply impact forces to an upper surface of the shoe acting to drive the shoe in downward movement;

providing a surface of the shoe which is transverse to the axis of the tube so that the downward movement of the shoe causes compressive forces on the material at the bottom of the hole for compressing the material;

engaging the tube adjacent an upper end by a drive tool and applying reciprocating rotation forces to the tube acting to cause reciprocating rotational movement of the tube back and forth about its axis;

providing a coupling between the tube and the shoe such that the reciprocating rotational movement of the tube is applied to the shoe to cause reciprocating rotational movement of the shoe relative to the material at the bottom of the hole;

providing on the shoe a material engaging member for engaging the compressed material at the bottom of the hole such that the reciprocating rotational movement of the shoe acts to break apart the compressed material and disperse at least some of the material outwardly from the axis to allow additional compression of the material from additional impact forces from the hammer;

and, when the material is compressed to a required extent from repeated impact forces and repeated reciprocating rotational movement, providing a pile in the hole to allow communication of longitudinal forces from a structure attached to an upper end of the pile to the compressed material.

In a particularly preferred arrangement the shoe is separate from the tube such that impact forces on the shoe cause the shoe to move downwardly relative to the tube and downward compressive forces are applied to the tube to move the tube gradually back to the shoe. Thus there is a sliding coupling between the shoe and the tube preferably formed by a sleeve of the shoe surrounding an end of the tube.

However the tube and shoe may be integral provided the tube is reciprocated at its upper end by a coupling between the tube and the drive member which allows the impact forces on the shoe to drive the shoe and the tube without transferring the impact forces to the drive member which would rapidly cause severe damage to the drive member. The tube and shoe can then be left in place in the finished cast pile. Alternatively the shoe and tube can be carefully withdrawn without damaging the compression of the material at the bottom of the hole.

Where the tube is separate and pressed downwardly to move to the shoe, preferably the downward compressive forces are applied through the drive tool.

The connection between the tube and shoe may be formed by the tube having an end which is inserted in a sleeve of the shoe, or vice versa.

Preferably there is provided an annular seal between the tube and the sleeve to prevent penetration of water from the hole into the tube.

In most cases, the pile is poured with concrete and reinforced but other constructions which transfer vertical forces from the ground to the compressed material can be used. Where the concrete is poured, the tube is preferably removed for reuse, but this is not essential.

Preferably, in order to provide best compression of the material beneath the shoe, the shoe has a bottom surface which lies in a radial plane of the axis.

Preferably the material engaging member comprises a plurality of blades which extend generally at right angles to a radial plane of the axis such that each blade can move with the shoe along the axis and such that rotation of the shoe causes the blade to twist about the axis and thus move the material relative to the axis.

The blades may be connected together to form an integral engagement member for strength.

The blades are arranged such that material can move outwardly from the axis to a position beyond an outer edge of the blades and beyond an outer edge of the shoe.

Preferably the hammer is mounted on a support which extends past the drive tool into the tube.

Preferably the hammer is a drop hammer carried on a lift cable which extends past the drive tool into the tube.

Preferably the drive tool includes a projecting piece which extends into an open mouth of the tube and wherein the projecting piece includes a passageway therein through which the support passes.

According to a second aspect of the invention there is provided an apparatus for installing a pile in the ground comprising:

a supporting vehicle;

a rotatable drill carried on the vehicle;

the rotatable drill being rotatable to provide as required both continuous rotation in a single direction and reciprocating rotational movement back and forth;

the rotatable drill being operable to provide compressive forces downwardly;

the rotatable drill having an attachment tool for carrying an auger flight to apply rotation thereto to drill the auger flight into the ground for drilling a hole in the ground;

the rotatable drill having a drive tool for engaging an upper end of a tube for applying thereto reciprocating rotational movement;

a hammer;

a winch carried on the vehicle for raising and lowering a support element carrying the hammer for application of impact forces downwardly within the tube;

the drive tool being arranged for allowing passage into the tube of the support element of the hammer while the drive tool is attached to the tube for application of the impact forces while the drive tool is attached to the tube.

According to a third aspect of the invention there is provided an apparatus for use in installing a pile in a hole in the ground comprising:

a bottom shoe for engaging material at the bottom of the hole;

the shoe having an upper surface of the shoe transverse to the axis of the hole arranged to receive impact forces to drive the shoe in downward movement;

the shoe having a bottom surface of the shoe which is transverse to the axis of the hole so that the downward movement of the shoe causes compressive forces on the material at the bottom of the hole for compressing the material;

the shoe having an upper sleeve surrounding the axis of the hole for receiving a tube within the hole;

the shoe having a coupling for engaging the tube such that a reciprocating rotational movement of the tube is applied to the shoe to cause reciprocating rotational movement of the shoe relative to the material at the bottom of the hole;

the shoe having a material engaging member for engaging the compressed material at the bottom of the hole shaped and arranged such that the reciprocating rotational movement of the shoe acts to break apart the compressed material and disperse at least some of the material outwardly from the axis to allow additional compression of the material from additional impact forces from the hammer.

BRIEF DESCRIPTION OF THE DRAWINGS

One embodiment of the invention will now be described in conjunction with the accompanying drawings in which:

FIGS. 12, 13 and 14 are respectively cross sectional views along the lines 12—12, 13—13 and 14—14 of FIG. 11.

In the drawings like characters of reference indicate corresponding parts in the different figures.

DETAILED DESCRIPTION

Figure 1:
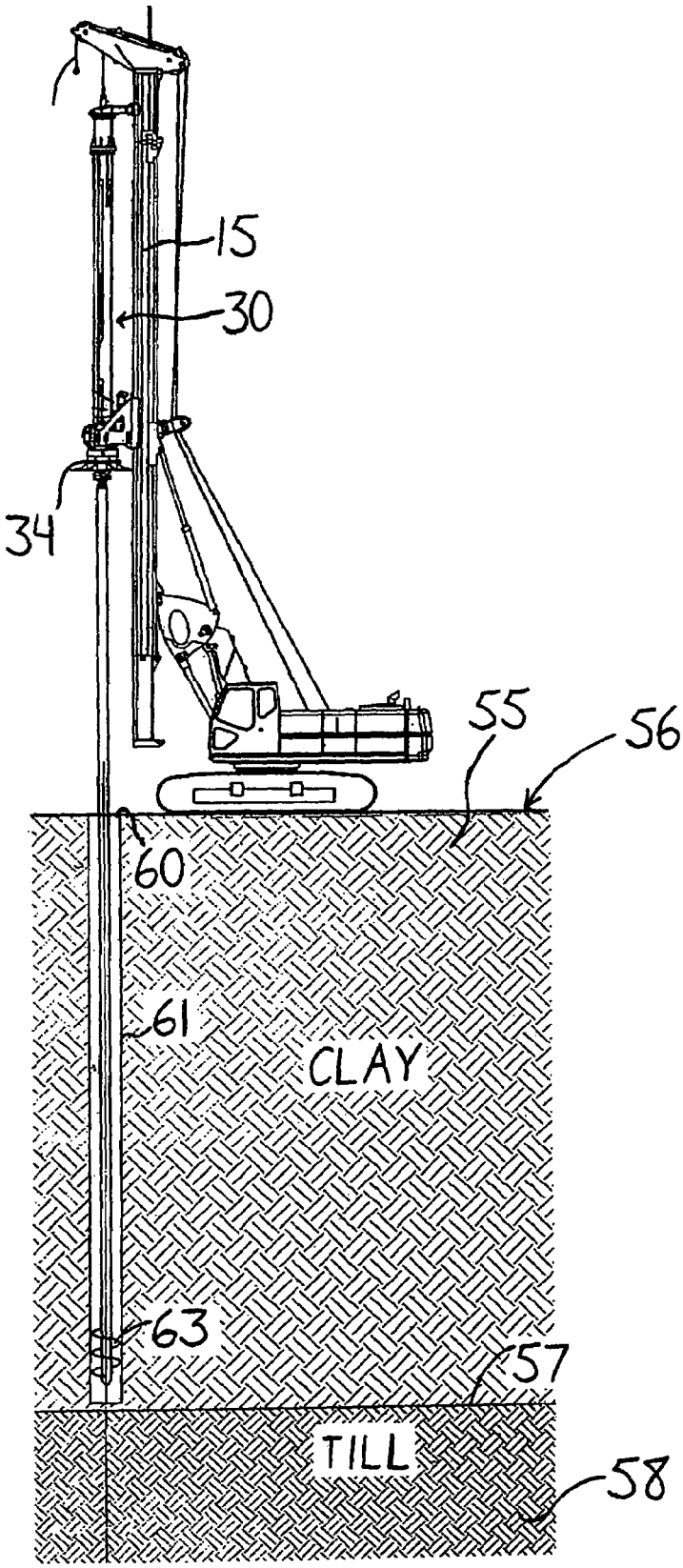
FIGS. 1 through 6 show six stages of operation in installation of a pile using a method according to the present invention.
Figure 1A:
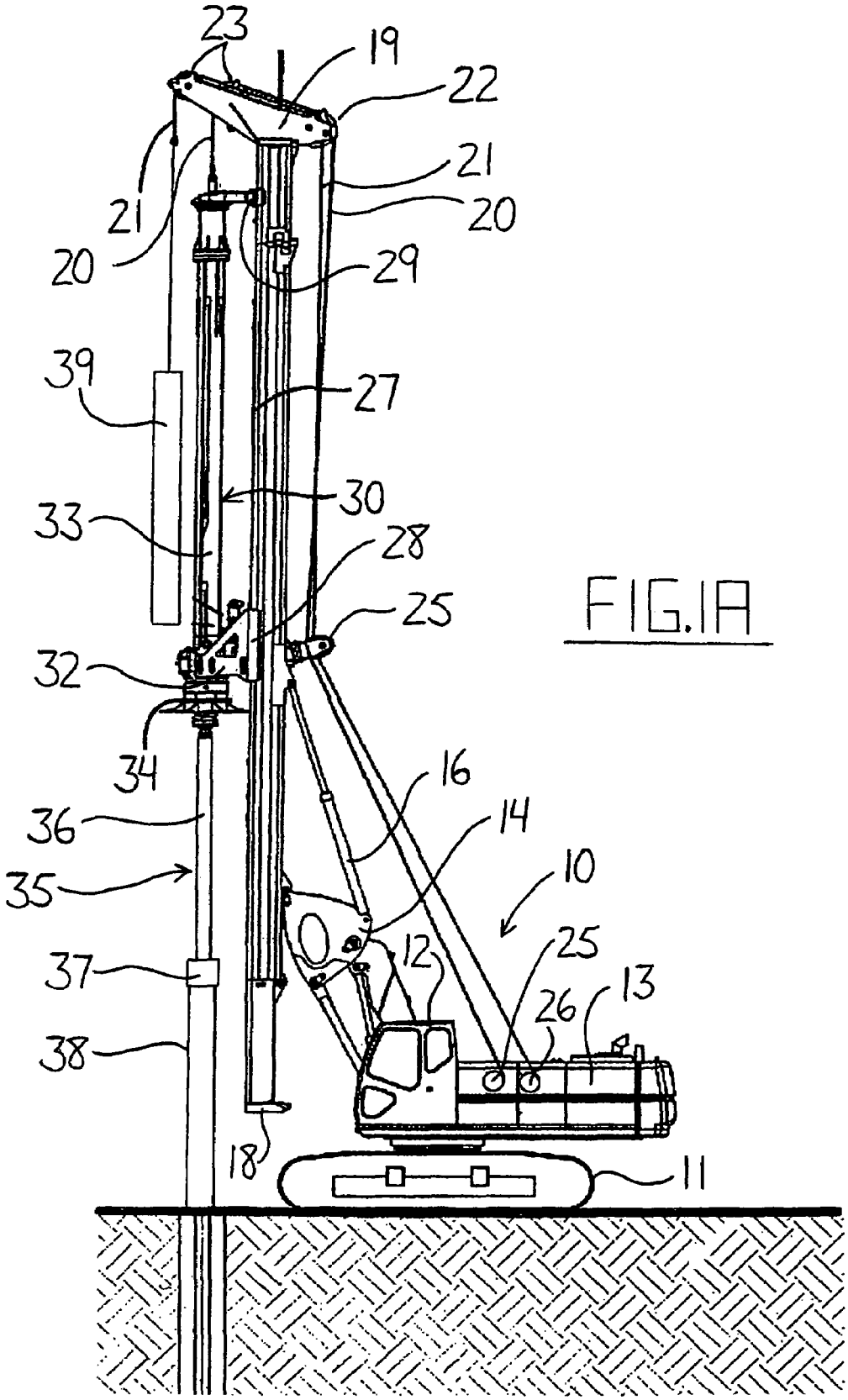
FIG. 1A is a side elevational view of a machine for use in installation of piles according to the present invention.

In FIG. 1A is shown in side elevational view a machine for use in installing piles which includes a number of conventional components which will not be described in detail together with components which are specifically designed for use in the present method.

The apparatus generally comprises a tractor unit 10 of a conventional nature mounted on tracks 11 and including a cab 12 and a drive system 13. The tractor carries a support system 14 for carrying a mast 15. The support system 14 is generally of a conventional nature and includes cylinders 16 and 17 which allow the height and inclination of the mast 15 to be adjusted. The mast 15 includes a foot 18 which is arranged to be located on the ground in front of the tractor 10 so as to locate the mast for operating upon an area of the ground in front of the mast and in front of the tractor.

At the top of the mast is provided an arm 19 which provides a support for a pair of cables 20 and 21 which extend to the arm over pulleys 22 and at 23 so as to depend downwardly in front of the mast and one in front of the other. The cables are guided over pulleys 25 part way along the rear of the mast so as to direct the cables from the arm 19 to winches 25 and 26 provided in the drive assembly 13 of the tractor. Thus each of the cables can be actuated independently to raise and lower the elements attached thereto on the front of the mast.

The mast further includes a guide track 27 which guides movements of support trolleys 28 and 29 of the tools to be moved along the length of the mast on the cable 20.

The tool carried on the cable 20 comprises a drive and rotation tool generally indicated at 30 which is of a commercially available construction and includes an upper arm 31 attached to the trolley 29 and a lower mounting 32 attached to the trolley 28. In-between the two mountings is provided a drive structure 33 in the form of a tubular member supporting the drive components and providing a rigid structural support between the trolleys 29 and 28 so that the structure is maintained vertical or parallel to the mast when vertical so as to provide vertical drive at a head 34 of the tool below the mounting 32. The tool is arranged to provide at the head 34 both rotation and vertical compression forces for driving various components into the ground.

The rotation is provided by a drive motor at the mounting 32 with the drive motor being operable either to provide rotation in a continuous forward direction, rotation in a continuous rearward direction or reciprocating rotation back and forth through an angle less than 360 degrees.

Tools of this type are commonly available and examples can be obtained from suppliers such as H & T Auger of Odessa Tex., W.F.J. Drilling Tools of Odessa Tex., Pengo Corporation and Texoma Drilling Tools of Sherman Tex.

The head 34 can therefore receive an auger flight for drilling a hole and for lifting drilled soil from the ground in a well known manner as described hereinafter or the head can receive a driving tool 35 for reciprocating driving movement of a tool as described herein after. The tool 35 comprises a drive shaft 36 attached to a drive head 37 which drives movement of a tube 38, all forming part of the tool 35. The action of the tool is described in more detail hereinafter.

The cable 21 carries a hammer 39 which is operated by simple lifting and dropping as an impact hammer for operating in the method described hereinafter.

Turning now to FIGS. 7 through 10, there is shown a shoe for mounting at the bottom end of the tube 38 as part of the pile installation tool 35. Thus the tube 38 has a bottom end 40 to which is attached the shoe 41. The shoe 41 includes a bottom wall 42 which lies in a radial plane of the longitudinal axis 43A of the tube so as to close the lower end of the tube. The shoe 41 includes a sleeve 43 attached to the bottom wall 42 and directly surrounding the bottom end 40. The sleeve 43 has a series of grooves 44 at axially spaced positions therealong each receiving an 0-ring seal 45 carried in the groove and projecting inwardly from an inside surface of the sleeve 43. The 0-rings seals thus act as a seal relative to the outside surface of the tube 38 so that the sleeve and bottom wall 42 of the shoe act as a closure for the lower end of the tube thus preventing the entry of water into the tube. The sleeve is however a sliding fit on the outer surface of the tube so that the sleeve and the bottom wall can move downwardly relative to the end of the tube.

The sleeve carries at its bottom edge at the wall 42 a plurality of block elements 46 which act as keys inserted into corresponding recesses 47 in the bottom end of the tube 38. Thus the shoe can be inserted in place on the bottom end of the tube and the plurality of blocks 46 at angularly spaced positions around the end of the sleeve inserted into corresponding openings or recesses at the end of the tube 38 similarly angularly spaced. Thus rotational movement of the tube is transferred into rotational movement of the shoe.

The end plate 42 lies in a radial plane so as to define an upper surface 40A which is flat within the area bounded by the blocks 46. The plate 42 also defines a bottom surface 49 which is also flat and lies in a radial plane so as to provide compression of material underneath the surface 49. The plate 42 and its surface 49 extends to the outer edge of the plate at the edge of the sleeve so as to form and outermost edge portion 50. On the underside of the plate 42 is attached a ground engaging member 51 formed by a plurality of blades 52 connected to form a generally H-shaped member. The blades lie at right angles to the bottom surface 49 that is at right angles to a radial plane of the axis. The blades are arranged so they do not form a closed hollow area but instead allow material disturbed by rotation of the shoe to move outwardly from the axis 43 toward the outer edge 50.

In the embodiment shown the blades are arranged at right angles and attached together as an integral structure in a H-shape. However alternative arrangements of the blades can be provided where the blades extend outwardly from a position closer to the axis to a position further away from the axis thus tending to cause the material to move outwardly and to break up material as the rotation occurs. An alternative arrangement could include blades which are connected together at the central axis and extend radially outwardly therefrom. The blades preferably terminate at a position spaced from the outer edge 50 so that the main part of the bottom surface 49 is available as a compression tool. The ground engaging member 51 and the plate 42 and the sleeve 43 are all attached together integrally as an integral structure which can be inserted onto the tube but removed from the tube by the sliding action of the sleeve relative to the outer surface of the tube.

Figure 11:
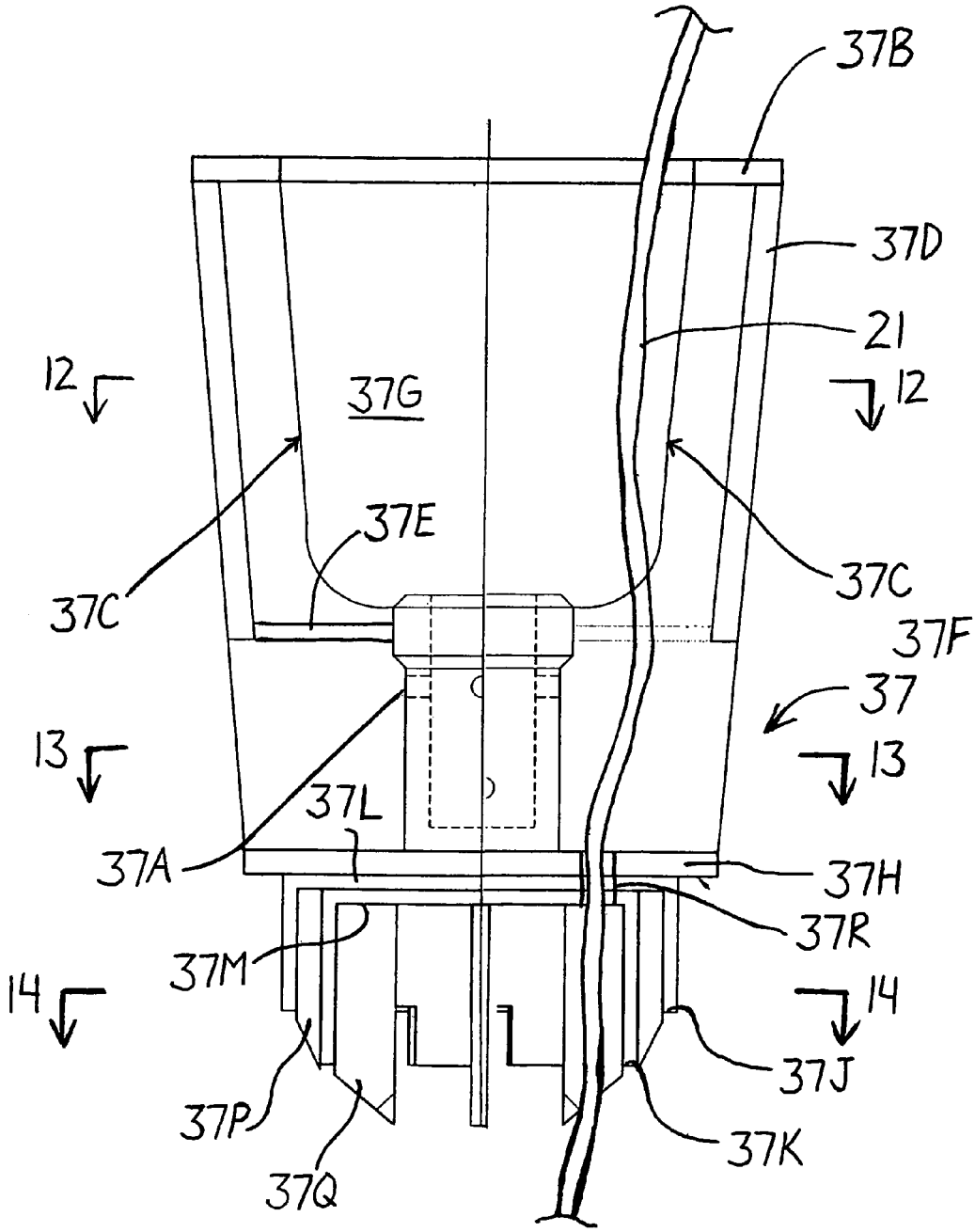
FIG. 11 is a vertical cross sectional view through the coupling member which acts to connect the drive of the reciprocating drive system to the tube.

In FIG. 11 is shown in more detail the cross section of the head 37 by which the top of the tube 38 is grasped to provide downward force on the tube and also to provide rotational force to the tube generated by the head 37. In addition the head 37 has a hollow interior which allows the cable 21 to pass through the hollow interior of the head 37.

The head 37 as shown in FIGS. 11, 12, 13 and 14 includes a receptacle 37A which forms a square cross section tube proceeding the conventional lower engagement end of the drive coupling of the tool. The receptacle 37A has sufficient length and sufficient strength to accommodate the high torque necessary for communicating forces from the drive to the tube 38. The drive tool improves the lower end of a shaft which engages into the receptacle to provide both downward pressure and rotation forces form the head of the tool.

The head further includes a top plate 37B which is arranged to receive downward pressure from a collar of the guide tool, if required. The guide tool thus includes a collar and the drive shaft which can be moved upwardly and downwardly independently of one another so mat when more enemy is required to apply significant downward force on the head, the collar of the tool is engaged onto the upper edge 37B of the head. The plate 37B is connected to the receptacle 37A by a plurality of ribs 37C and by interconnecting filler pieces 37D. This forms a hollow interior 37G inside the wall defined by the rib and filler pieces and underneath the top plate 37D. The bottom of the hollow interior is closed by a plurality of transverse wall pieces 37E. One of the pieces is omitted to provide an opening 37F at the bottom of the hollow interior 37G.

At the bottom of the ribs 37C is attached the transverse plate 37H which provides a force transfer plate attached to the receptacle 37A and to the ribs through which the longitudinal and rotational forces are communicated into the plate 37H. On the underside of the plate 37H is attached two tube coupling elements 37J and 37K. Each of these is formed by a cylindrical wall and the base plate 37L and 37M respectively which are attached to the plate 37H. The cylindrical wall has a diameter matching that of the tube to be driven. Thus the two separate coupling elements 37J and 37K are designed for two separate tube diameters. It will be appreciated that only one coupling element may be provided or more than two can be provided so as to accept different diameters of tube as required. The cylindrical wall of each coupling is castellated so as to match a corresponding castellated section at the top of the tube. Each coupling includes also a chamfered guide 37P, 37Q respectively where each guide is formed by four separate flange elements which are chamfered so as to guide the tube to center the tube on the common axis with the respective coupling and hold it in place during the communication of longitudinal and rotational forces.

A hole 37R is formed through the plate 37H, 37L and 37N which is generally aligned with the opening 37F to allow the passage of the support cable 21 for the hammer. Thus the support cable 21 as best shown in FIG. 11 passes through the hollow interior 37G along side the drive shaft (not shown) engaging into the receptacle 37A and then passes through the opening 37F to the hole 37R where it can enter into the interior of the respective tube attached with the respective coupling 37J or 37K.

The ground construction is shown in the figures and includes an overburden of sedimentary clay 55 which extends from the ground surface 56 to a top surface 57 of a layer of glacial till 58. The depth of the clay varies in various locations. The glacial till is common in areas where receding glaciers have eroded the soil to provide the till with an upper surface and a thickness through the till which also can vary down to bedrock below the till. The intention is to provide a pile which extends through the sedimentary clay which is unsuitable to support the pile and into an upper surface of the till. The till is well known to provide sufficient support for a pile but only if compression of the till occurs up to a certain suitable level to provide a required resistance to downward movement of the pile on application of a load from the ground surface. The intention is therefore to provide the pile buried within the till with compression of the till underneath of the pile while avoiding the necessity for driving a performed pile form the surface.

Turning now to the method of installation of the pile as shown in FIGS. 1 through 6, a series of steps are shown utilising the elements described above.

In the first step of FIG. 1 the head 34 on the tool 30 is used with the mast vertical in position at a required pile location 60 to drill a hole 61.

The hole 61 is drilled through the clay 55 to the upper surface 57 of the till. Drilling through the clay is relatively straightforward since the clay is sedimentary and thus contains little in the way of large boulders or obstacles which can interfere with the drilling process. Drilling through the clay is generally necessary for a distance of the order of 7.0 to 15.0 meters depending upon the location. The drill action is carried out using conventional methods in which the auger flight 63 is drilled into the ground and extracted to remove the earth carried on the flight allowing a further drilling action to occur.

In this state the cable 21 remains unused and the drilling action is effected using the tool 30 moving in a sliding action along the mast 15.

Figure 2:
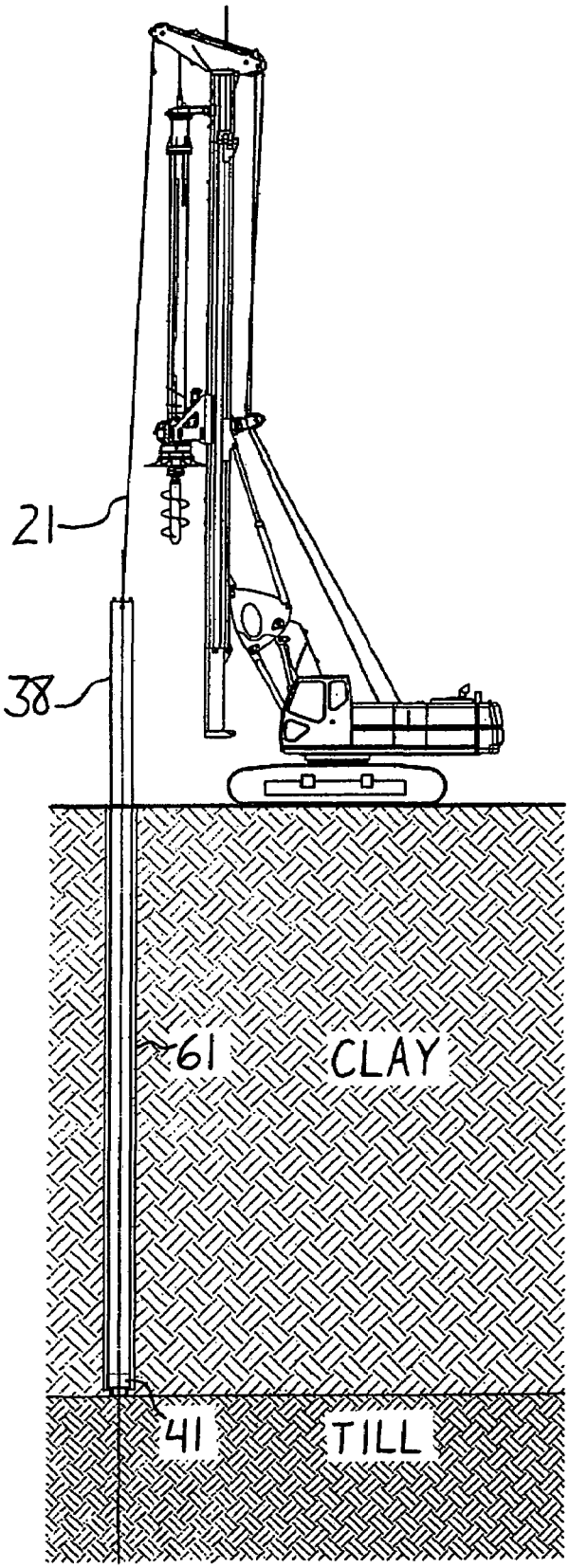

Turning now to FIG. 2, when the drilling action is complete, the auger is removed and the tube 38 installed into the drilled hole 61 using the lifting action of the cable 21 and its winch 26. On the bottom of the tube 38 is attached the shoe 41 which is inserted in place and held in place by the frictional fit between the sleeve and the outer surface of the tube. The tube is thus dropped to the bottom of the drilled hole and thus sits on the upper surface 57 of the till 58.

Figure 3:
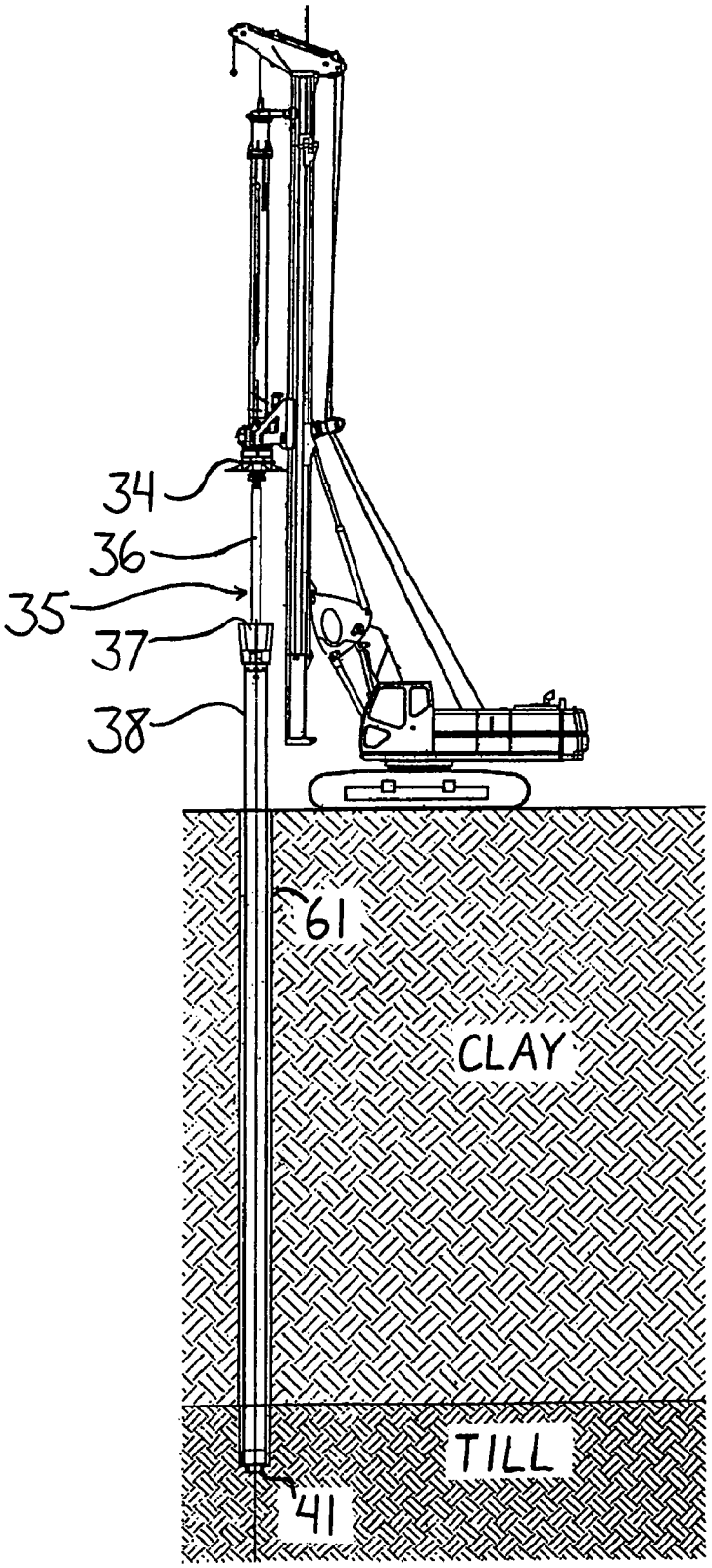

As shown in FIG. 3, the cable 21 is released from the upper end of the tube 38 exposing the upper end of the tube 38 of the top of the hole 61. The head 34 has the auger flight removed therefrom and replaced by the tool 35 including the connecting rod 36 engagement head 37 which engages onto the top of the tube 38. The drive head 34 is changed in operation from the continuous rotation mode for the drilling action using the auger flight to a reciprocating mode in which the head 37 is reciprocated back and forth generally of an angle less than 360 degrees. At the same time the head 34 is arranged to apply pressure downwardly onto the connecting rod 36 and the head 37 thus applying pressure to the tube 38 and the shoe 41. The application of pressure together with the back and forth reciprocation of the tube 38 and therefore of the shoe 41 causes the shoe 41 to work its ways downwardly into the till by a compression action and reciprocation action which compresses the material underneath the shoe and also diverts the material outwardly to the sides of the shoe.

It is well known and well established that such a reciprocation action known as a "displacement pile" only allows the shoe to be worked into the till over a relatively short distance with insufficient compression of the till material to provide sufficient support of the pile to accommodate suitable loadings at the ground surface. Such displacement piles are therefore only rarely used and are generally unsatisfactory.

Figure 4:
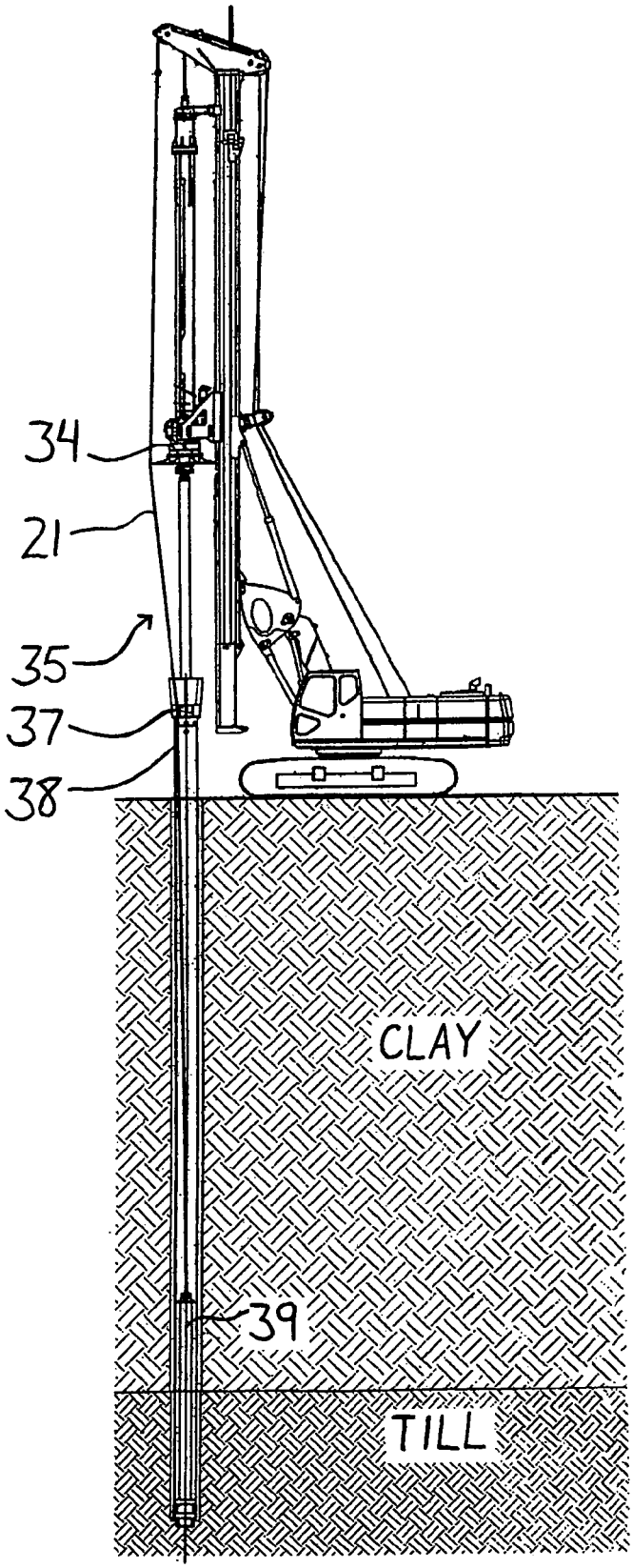
Figure 5:
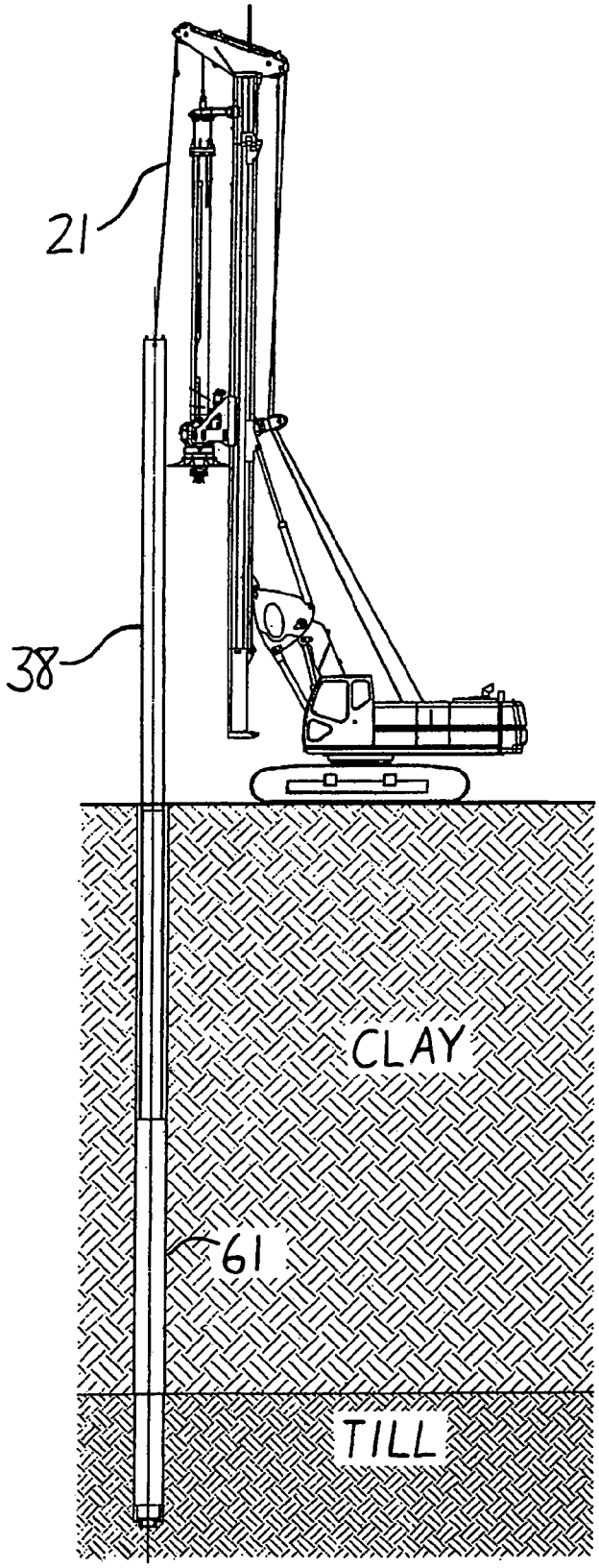
Figure 6:
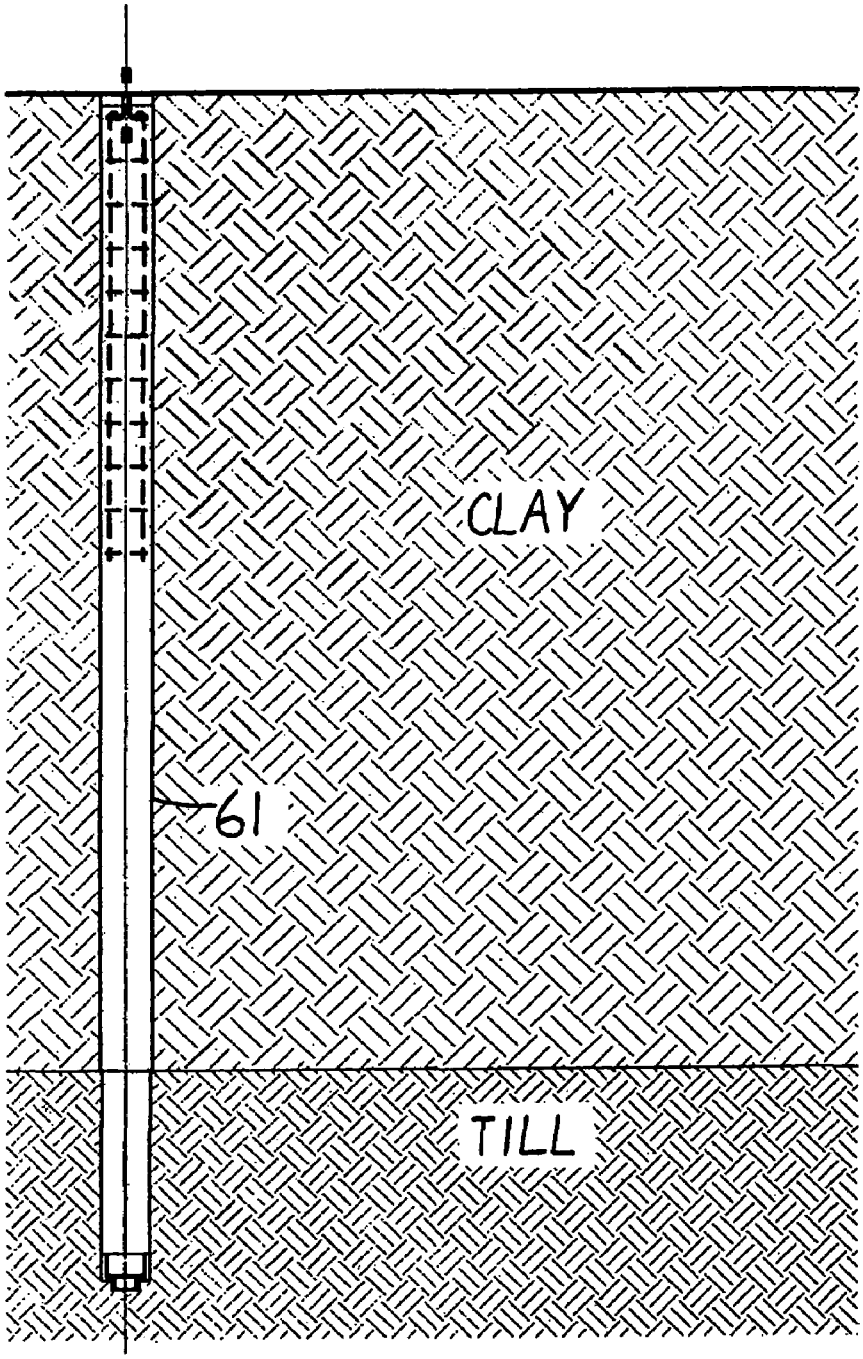
Figure 7:
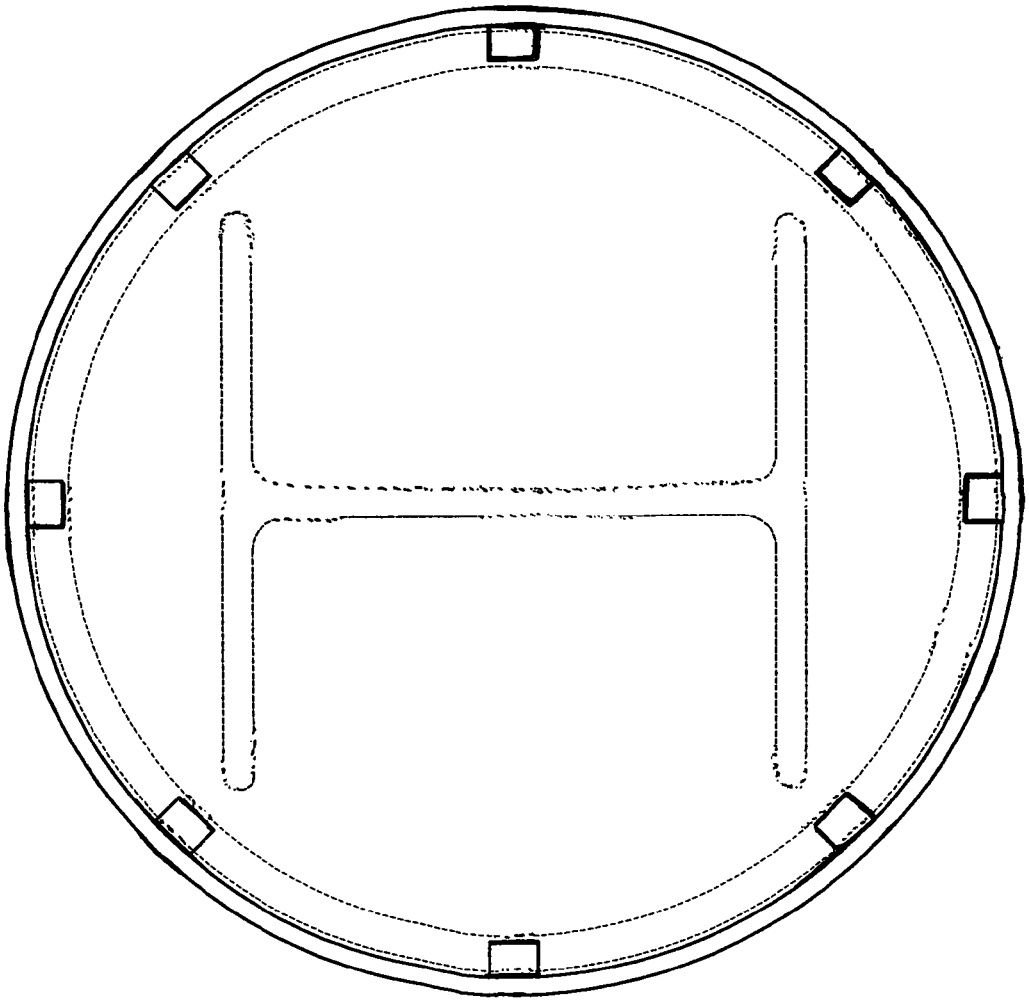
FIG. 7 is a top plan view of the shoe previous to the method shown above.
Figure 8:
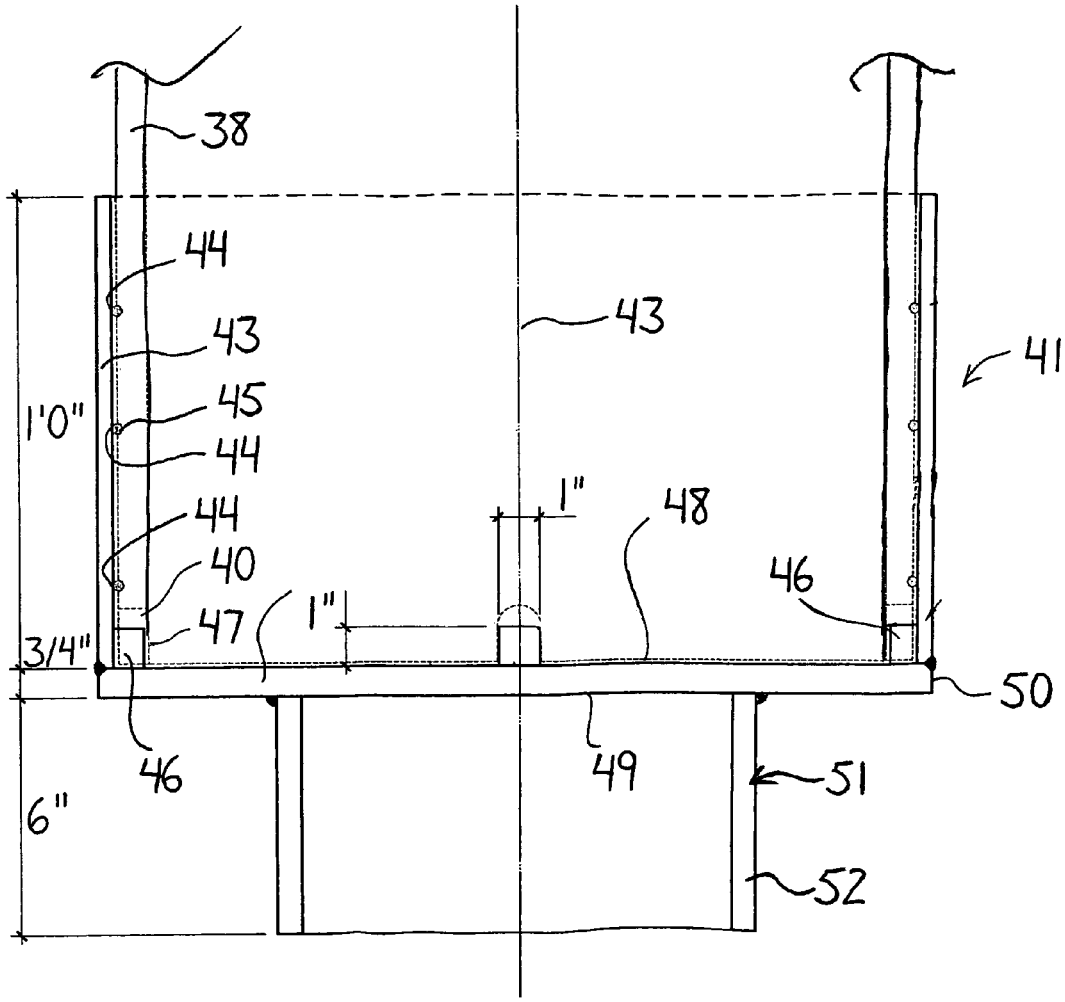
FIG. 8 is a vertical cross section through the shoe and tube for the method shown above.
Figure 9:
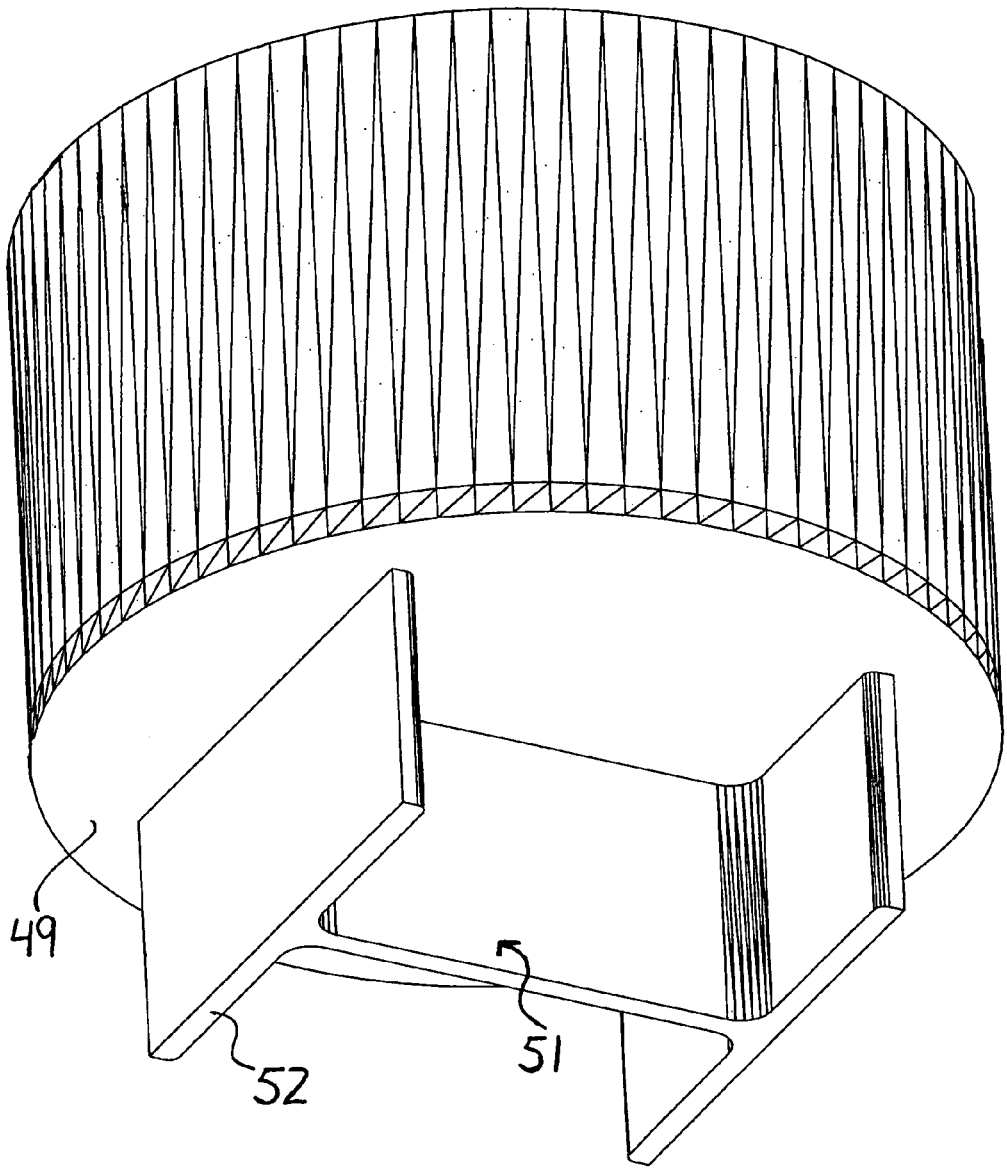
FIG. 9 is an isometric view from the underside of the shoe of FIG. 7.
Figure 10:
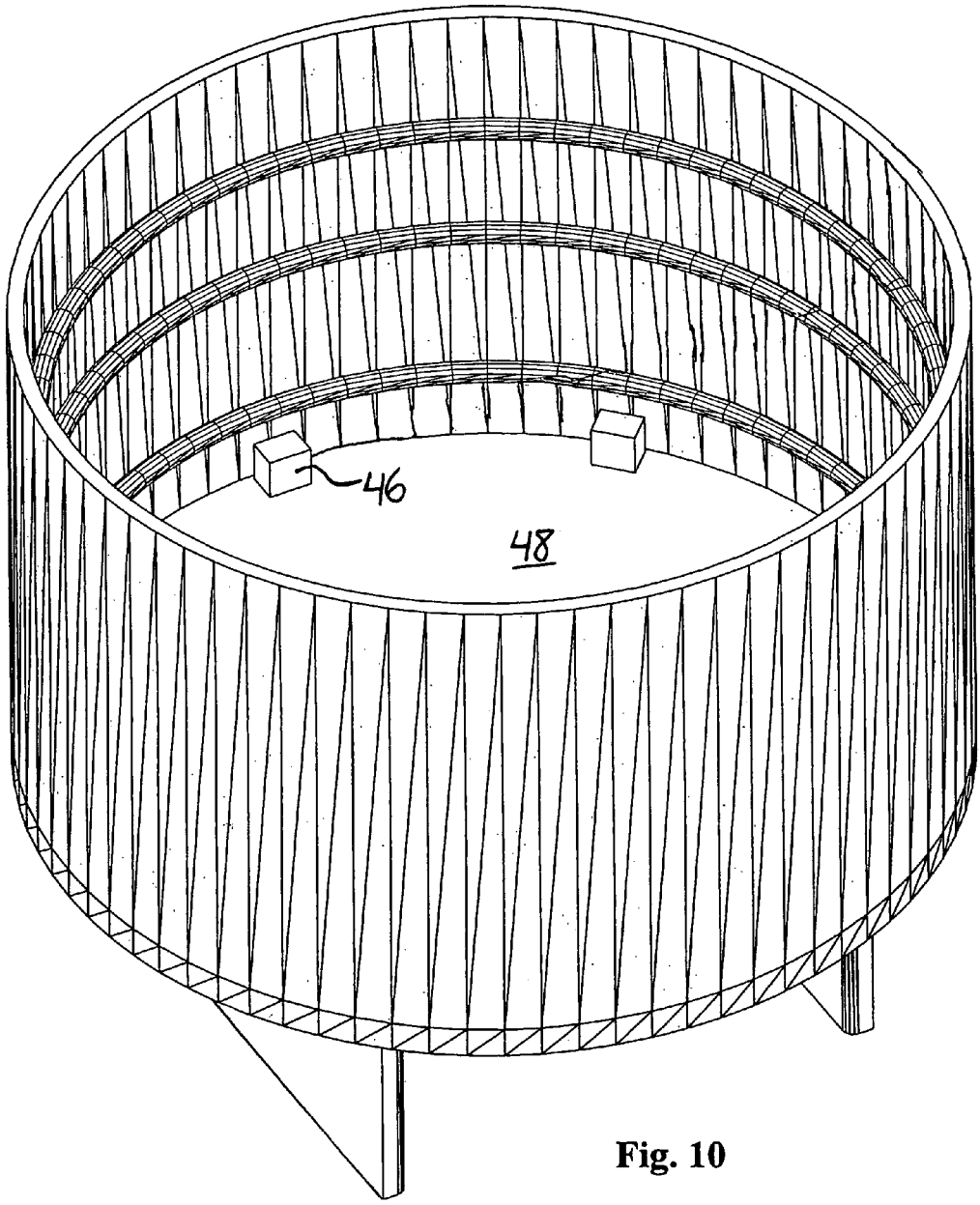
FIG. 10 is an isometric view from the top of the shoe of FIG. 7.

Turning now to FIG. 4, the further stage in the process involves the removal of the head 37 from the top of the tube 38 temporarily to expose the open top of the tube 38. This action is effected by temporarily lifting the tool 35 on the head 34 to expose the open top of the tube. In this position the hammer 39 which is lifted on the cable 21 is lowered into the open upper mouth of the tube so as to enter the hammer 39 into the interior of the tube so as to slide downwardly to the bottom of the tube. With the hammer in place in the tube and the cable passing through the open mouth, the tool 35 is returned to its initial position so that the head 37 is reapplied to the top of the tube 38.

In this arrangement as shown in FIG. 4, the impact hammer 39 can be actuated by raising the hammer within the tube to the top of the tube, allowing the hammer to drop along the tube to impact on the upper surface 48 of the shoe. This impacting action on the shoe applies impact forces directly to the shoe at an area deep within the ground and within the till so as to drive the shoe downwardly relative to the tube. The tube is held in the tool 35 by the head 37 so the tube tends to remain in place as the shoe is driven downwardly thus providing relative movement between the shoe and the tube driving the show downwardly away from the bottom end of the tube. This movement occurs only over a short distance which is generally of the order of or less than 25 mm so that the amount of movement allows the bottom end of the tube to remain within the sleeve and the tabs or blocks of the shoe to remain in engagement with the respective receptacles at the bottom end of the tube. With the tool 35 thus applying downward compressive forces on the tube, the tube is thus gradually compressed back to its position up against the upper surface of the shoe while the reciprocating action of the tube and the shoe is repeated. This impacting action thus acts to vigorously compress the material underneath the shoe downwardly by the bottom surface of the shoe and then the reciprocating rotation causes the ground engagement blades to break up or excise the material underneath the bottom surface causing it to be expelled outwardly from the axis of the tube. It has been found that this repeated impacting at the shoe together with the compression of the tube and the reciprocating action of the tube causes the shoe to be driven downwardly within the till to a greater distance.

Typically initial operation using reciprocation and compression as shown in FIG. 3 causes the shoe to be driven into the till by a distance of the order of 0.5 meters. The further operation provided by the impacting action followed by the reciprocating and compression can act to drive the shoe further into the till by a distance of the order of 1.0 meters leading to a total depth of the order of 1.5 meters within the till. This distance has been found to provide sufficient compression of the material underneath the bottom of the shoe to provide a resistance against the pile sufficient to accommodate up to 1200 KN loading on the top of the pile.

When the driving action of the method shown in FIG. 4 is complete, that is it has reached the stage where no further movement is obtained by the application of the compressive and reciprocating forces and by the application of the impact from the hammer, the tool 35 is removed from the tube 38.

With the tube 38 remaining temporarily in place, a poured concrete pile is formed within the tube using conventional techniques so that the poured concrete sits on the shoe 41 at the bottom of the hole and applies loading from the ground to the shoe. Poured concrete piles of this type are well known and utilize the necessary reinforcing bars and concrete material so that the loading can be effectively transferred from the ground through the poured concrete reinforced pile to the shoe so that the loading is applied to the shoe and through the shoe to the compressed material underneath the shoe within the till.

After pouring the concrete, the tube 38 is lifted by the winch 26 and the cable 21 so as to lift the tube out of the hole 61 leaving the shoe and concrete in position in the hole. The shoe remains in position due to its vigorous engagement into the material within the till at the bottom of the hole which overcomes the sliding friction between the tube and the inside of the sleeve. Thus lifting the tube causes the lower end of the tube to slide out of the sleeve and the tube to be extracted from the hole 61 for reuse.

As set forth above a pile of this sort can provide a loading at the surface of at least 450 KN and preferable of the order of 800 KN to 1200 KN. These loadings approximate to the level of loading which can be obtained by a conventional driven pile. However the structure is simpler, less expensive and less damaging to the environment than is the conventional driven performed concrete pile.

In a first alternative, the impacting action can be applied directly when the shoe and tube are inserted into the ground so that all of the driving action of the shoe is effected using both the impacting action together with the driving and reciprocating action on the top of the tube.

In the further alternative arrangement, the tube and shoe can be formed as an integral structure so that the impacting action on the shoe drives both the shoe and the tube simultaneously downwardly. This arrangement requires that there is a slip coupling either at the head 37 or at the head 34 so as to allow the tube to move downwardly relative to the head under the impact action. It will be appreciated that the instantaneous movement caused by the impacting action cannot be accommodated in the head 34 or the head 37 without the application of such a slip connection since it would cause damage to the hydraulic system which provides the gradual compression forces and provides the rotation action. In this arrangement it is generally necessary to leave the tube and shoe in place so this is a less preferred method particularly from the cost point of view though it is practically possible to provide a pile structure in a manner which is more effective and less expensive than the conventional drive performed pile.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for installing a pile in the ground comprising:

drilling a hole in the ground to a bottom of the hole at an initial depth;

inserting in the hole a tube extending along the length of the hole to the bottom;

providing on a bottom end of the tube a bottom shoe for engaging material at the bottom of the hole;

inserting into the tube a hammer and operating the hammer to apply impact forces to an upper surface of the shoe acting to drive the shoe in downward movement;

providing a surface of the shoe which is transverse to the axis of the tube so that the downward movement of the shoe causes compressive forces on the material at the bottom of the hole for compressing the material;

engaging the tube adjacent an upper end by a drive tool and applying reciprocating rotation forces to the tube acting to cause reciprocating rotational movement of the tube back and forth about its axis;

providing a coupling between the tube and the shoe such that the reciprocating rotational movement of the tube is applied to the shoe to cause reciprocating rotational movement of the shoe relative to the material at the bottom of the hole;

providing on the shoe a material engaging member for engaging the compressed material at the bottom of the hole such that the reciprocating rotational movement of the shoe acts to break apart the compressed material and disperse at least some of the material outwardly from the axis to allow additional compression of the material from additional impact forces from the hammer;

and, when the material is compressed to a required extent from repeated impact forces and repeated reciprocating rotational movement, providing a pile in the hole to allow communication of longitudinal forces from a structure attached to an upper end of the pile to the compressed material.

2. The method according to claim 1 wherein the shoe is separate from the tube such that impact forces on the shoe cause the shoe to move downwardly relative to the tube and wherein downward compressive forces are applied to the tube to move the tube back to the shoe.

3. The method according to claim 2 wherein the downward compressive forces am applied through the drive tool.

4. The method according to claim 1 wherein the tube has an end which is inserted in a sleeve of the shoe.

5. The method according to claim 1 wherein there is provided an annular seal between the tube and the sleeve to prevent penetration of water from the hole into the tube.

6. The method according to claim 1 wherein the tube is removed, leaving the shoe in place to support the pile.

7. The method according to claim 1 wherein the pile is poured reinforced concrete.

8. The method according to claim 1 wherein the shoe has a bottom surface which lies in a radial plane of the axis.

9. The method according to claim 1 wherein the material engaging member comprises a plurality of blades which extend generally at right angles to a radial plane of the axis such that each blade cart move with the shoe along the axis and such that rotation of the shoe causes the blade to twist about the axis and thus move the material relative to the axis.

10. The method according to claim 9 wherein the blades are connected together to form an integral engagement member.

11. The method according to claim 9 wherein the blades are arranged such that material can move outwardly from the axis to a position beyond an outer edge of the blades and beyond an outer edge of the shoe.

12. The method according to claim 1 wherein the hammer is mounted on a support which extends past the drive tool into the tube.

13. The method according to claim 12 wherein the hammer is a drop hammer carried on a lift cable which extends past the drive tool into the tube.

14. The method according to claim 12 wherein the drive tool includes a projecting piece which extends into and engages an open mouth of the tube and wherein the projecting piece includes a passageway therein through which the support passes.

15. An apparatus for installing a pile in the ground comprising:

a supporting vehicle;

a rotatable drill carried on the vehicle;

the rotatable drill being rotatable to provide as required both continuous rotation in a single direction and reciprocating rotational movement back and forth;

the rotatable drill being operable to provide compressive forces downwardly;

the rotatable drill having an attachment tool for carrying an auger flight to apply rotation thereto to drill the auger flight into the ground for drilling a hole in the ground;

the rotatable drill having a drive tool for engaging an upper end of a tube for applying thereto reciprocating rotational movement;

a hammer;

a winch carried on the vehicle for raising and lowering a support element carrying the hammer for application of impact forces downwardly within the tube;

the drive tool being arranged for allowing passage into the tube of the support element of the hammer while the drive tool is attached to the tube for application of the impact forces while the drive tool is attached to the tube.

16. The apparatus according to claim 15 wherein the hammer is a drop hammer and the support element comprises a lift cable which extends past the drive tool into the tube.

17. The apparatus according to claim 16 wherein the drive tool includes a projecting piece which extends into an open mouth of the tube and wherein the projecting piece includes a passageway therein through which the support element passes.

* * * * *